United States Patent [19]

Loo

[11] 4,178,049

[45] Dec. 11, 1979

[54] SHELF BOX WITH DUAL PIVOTING STOP MECHANISM

[75] Inventor: Ricky F. Loo, Batavia, Ill.

[73] Assignee: Lyon Metal Products, Incorporated, Aurora, Ill.

[21] Appl. No.: 923,323

[22] Filed: Jul. 10, 1978

[51] Int. Cl.[2] ..... A47B 88/16

[52] U.S. Cl. ..... 312/286; 312/348

[58] Field of Search ..... 312/286, 333, 319, 348

[56] References Cited

U.S. PATENT DOCUMENTS

| | | | |
|---|---|---|---|
| 1,143,443 | 6/1915 | Schramm | 312/286 |
| 2,272,819 | 2/1942 | Poetsch et a. | 312/286 |
| 2,565,784 | 8/1951 | Sheean | 312/333 |

*Primary Examiner*—Mervin Stein
*Assistant Examiner*—Alexander Grosz
*Attorney, Agent, or Firm*—Vogel, Dithmar, Stotland, Stratman & Levy

[57] ABSTRACT

A shelf box is designed for use with a shelf rack or storage cabinet open on both sides so that the shelf box can be removed from either side of the rack or cabinet. Two stop members are respectively mounted adjacent to opposite ends of the shelf box for pivotal movement between stop and release positions, and are interconnected by a pivoting linkage so that when one stop member is in its stop position the other stop member is in its release position. The stop members are disposed so that in their stop positions they are engageable with retaining portions of the overlying shelf. Thus, when one end of the shelf box is withdrawn from the rack or cabinet it will be stopped by engagement of the adjacent shelf retaining portion with the stop member at the opposite end of the shelf box in its stop position to prevent inadvertent complete removal of the shelf box. If the stop member adjacent to the end being withdrawn is in the stop position it will engage the adjacent shelf retaining portion for cammed movement of the stop member to its release position, thereby simultaneously moving the stop member at the opposite end of the shelf box to its stop position. The linkage interconnecting the stop members provides bearing surfaces for non-snagging sliding of side-by-side shelf boxes with respect to each other.

14 Claims, 7 Drawing Figures

SHELF BOX WITH DUAL PIVOTING STOP MECHANISM

BACKGROUND OF THE INVENTION

The present invention relates to shelf boxes for use in shelving racks, storage cabinets and the like, typically for the storage of small parts. Such shelf boxes are well known in the art and are normally equipped with a stop member at the rear end of the box which is engageable with a turned down flange on the front of the shelf above the box to prevent the box from accidentally being pulled off the shelf.

Such shelf boxes are extensively used, for example, in warehouses or parts distribution centers for the storage of large number of different types and sizes of parts. In the typical warehouse arrangement, the storage racks or cabinets are arranged in long parallel rows with aisles therebetween. Normally, the shelf box can be withdrawn from only one side of the rack or cabinet. This can cause congestion when several people want access to different boxes which are disposed closely adjacent to one another in a rack or cabinet.

Therefore, it has been found to be desirable to arrange shelf racks or storage cabinets so that the shelf boxes thereon can be removed from either side of the rack. Thus, if a person cannot reach a box from one side of the rack, he can move around to the aisle on the opposite side of the rack and gain access to the box from that position. This necessitates shelf boxes which can be withdrawn or opened from either side of the shelf rack or storage cabinet. This has been impossible with prior art shelf boxes since the stop member at the rear of the cabinet which limits the extended withdrawal at one side of the rack will completely prevent withdrawal at the other side of the rack.

Double-acting drawers, panels or other furniture members are known in the art which can be withdrawn or opened from either side of a furniture cabinet. But such prior art devices have required the use of complicated movable stop mechanisms mounted on the cabinet for each drawer or other withdrawable member. Such stop mechanisms are shown, for example, in the U.S. Pat. No. 2,599,865, issued to E. G. Rudman on June 10, 1952. These cabinet-mounted movable stop mechanisms would be completely unsuitable for a shelf box type of application, since there may be hundreds of shelf boxes in a single cabinet or rack and the provision of cabinet-mounted stop assemblies for each shelf box would result in a prohibitively expensive and complicated rack or cabinet structure, as well as a considerable waste of space.

Furthermore, it is common in warehouse applications of shelf boxes that the rack construction permits the mounting of shelves with different spacings therebetween for accommodating shelf boxes of varying heights and, furthermore, on any given shelf, shelf boxes of varying widths may be stored. This flexibility would be effectively destroyed if it were necessary to provide complicated rack-mounted stop assemblies for each shelf box.

Other double-opening drawers are shown, for example, in the U.S. Pat. No. 2,914,370, issued to E. J. Hensch et al. on Nov. 24, 1959. The Hensch et al. apparatus includes latch mechanism which must be manually operated or disengaged in order to open the drawer in either direction. Such latch mechanism adds considerable expense and complication to the construction of the mechanism, while also complicating the operation thereof. These disadvantages would effectively prohibit operation of the Hensch et al. type of device in a shelf box environment. Also, the Hensch et al. device necessitates the mounting of movable latch means on the cabinet assembly for each drawer, with the attendant disadvantages which were discussed above in connection with the Rudman patent.

SUMMARY OF THE INVENTION

It is a general object of the present invention to provide a shelf box construction which can be withdrawn from either side of a shelf rack or storage cabinet, while at the same time effectively preventing accidental complete withdrawal of the shelf box from the rack or cabinet in either direction.

An important feature of the present invention is the provision of a shelf box of the character described which is of simple and economical construction and is characterized by ease of operation, with the shelf box being operated in precisely the same manner as prior art shelf boxes which could be withdrawn in only one direction.

More particularly, it is a feature of the present invention that the shelf box is provided with a dual stop members mounted on the shelf box for cooperation with retaining portions on the adjacent shelves, thereby permitting operation of any number of different sizes of shelf boxes with standard shelf or rack structure without modification of the rack structure.

Another feature of this invention is the provision of a shelf box with stop mechanism of the character described, wherein the stop members are linked together for simultaneous actuation.

It is an object of this invention to attain these features by providing a shelf box for use at either side of a shelf rack which includes a plurality of parallel spaced-apart shelves each having two retaining portions, the shelf box comprising an open-top receptacle having opposed ends and being adapted for slidable disposition between adjacent ones of the associated shelves from either side thereof and dimensioned longitudinally to extend substantially from one side to the other side of the associated rack, a first stop member mounted on the receptacle adjacent to a first one of the ends for movement between a stop position engageable with the retaining portions of one of the adjacent shelves and a release position non-engageable with the retaining portions of the shelves, a second stop member mounted on the receptacle adjacent to a second one of the ends for movement between a stop position engageable with the retaining portions of one of the adjacent shelves and a release position nonengageable with the retaining portions of the shelves, each of the stop members in the release position thereof accommodating withdrawal of the adjacent end of receptacle from the associated rack, each of the stop members in the stop position thereof being engageable with one of the associated retaining portions for movement of that stop member to the release position thereof to accommodate withdrawal of the adjacent end of the receptacle from the associated rack and being engageable with the other of the associated retaining portions for limiting withdrawal of the opposite end of the receptacle from the associated rack, and control means for effecting movement of each of the stop members from the release position to the stop position thereof, whereby the shelf box may be opened from either side of the rack while preventing inadvertent complete removal of the shelf box from the rack.

Further features of the invention pertain to the particular arrangement of the parts of the shelf box whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
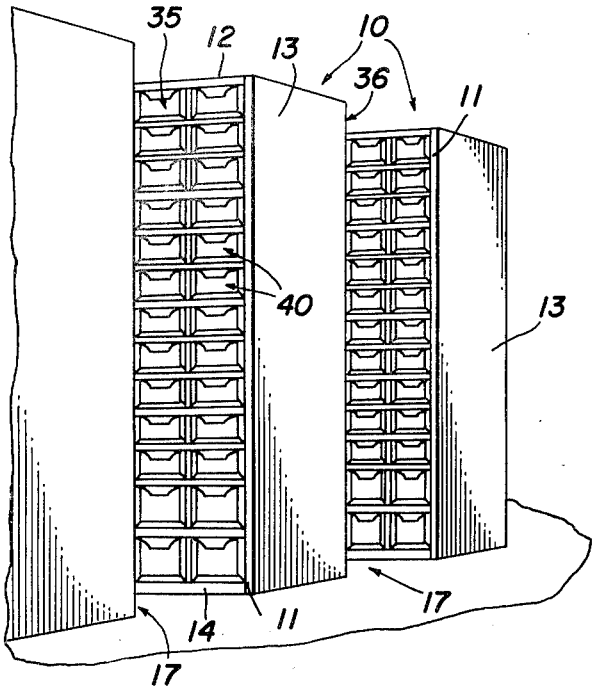
FIG. 1 is a perspective view of a plurality of shelf racks, separated by aisles, with each shelf rack including a number of shelf boxes therein constructed in accordance with and embodying the features of the present invention.

Referring to FIG. 1 of the drawings, there is illustrated a plurality of shelf racks, each generally designated by the numeral 10, arranged in spaced-apart rows with aisles 17 therebetween for supporting thereon a plurality of shelf boxes 40. Each of the shelf racks 10 includes a plurality of upright corner posts 11 interconnected at the upper ends thereof by a top wall 12. The pairs of posts 11 at each end of each shelf rack row are closed by an upstanding end wall 13, the end walls being interconnected by parallel bottom sills 14. There is, thus, provided an upstanding rectangular shelf rack structure closed at the top and bottom and at both ends, and open on both sides.

Figure 2:
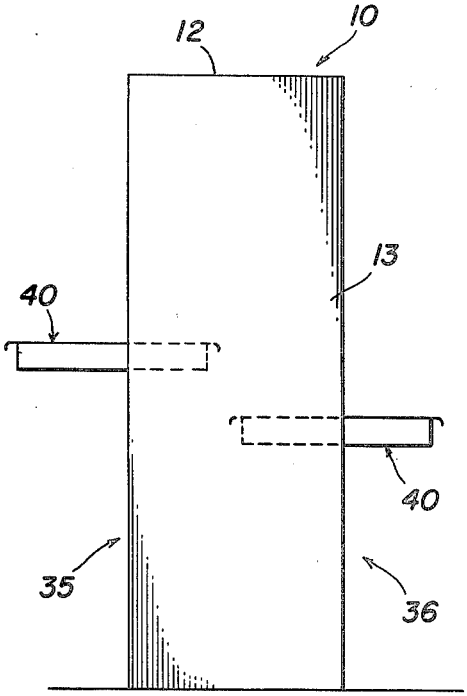
FIG. 2 is an end elevational view of one of the storage racks in FIG. 1, as viewed from the right-hand side thereof, illustrating two of the shelf boxes respectively withdrawn from opposite sides of the storage rack.
Figure 3:
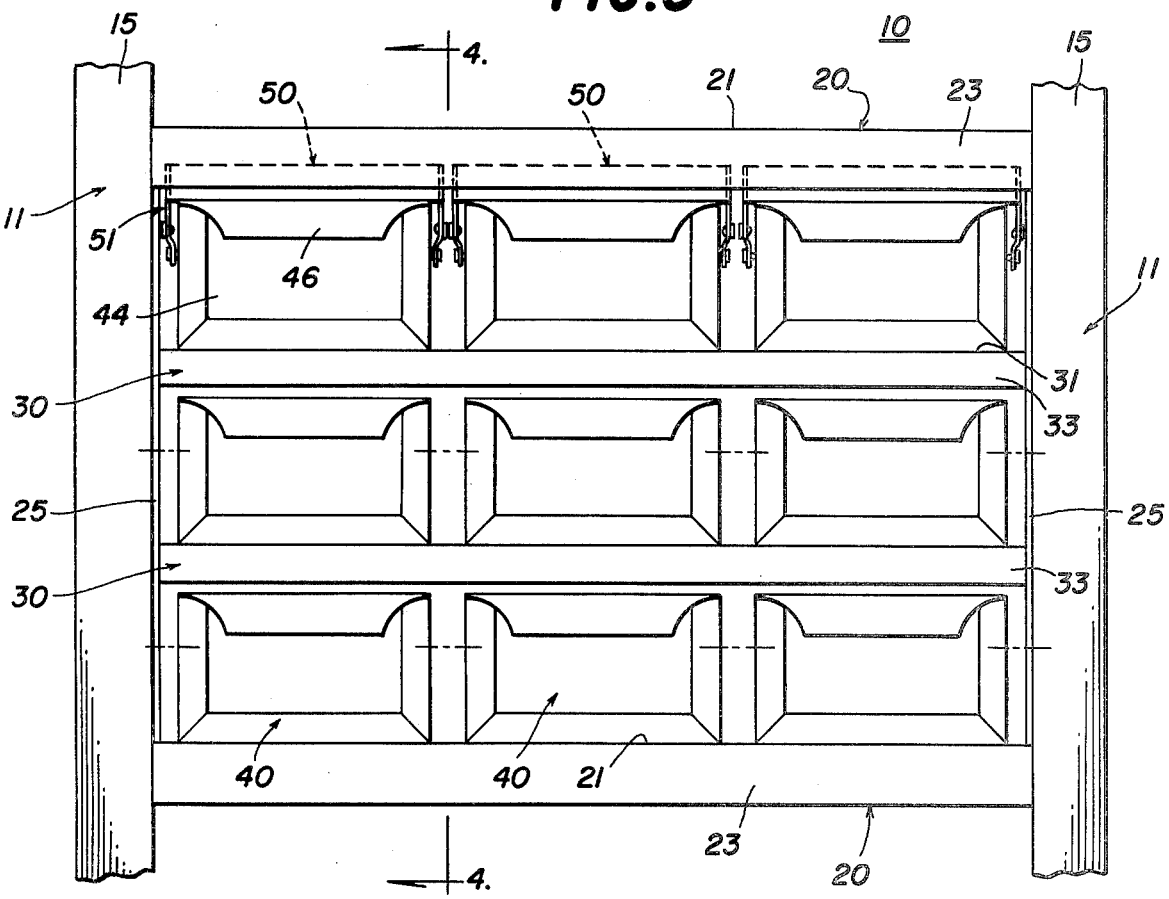
FIG. 3 is an enlarged fragmentary front elevational view of one side of one of the storage racks illustrated in FIG. 1.
Figure 4:
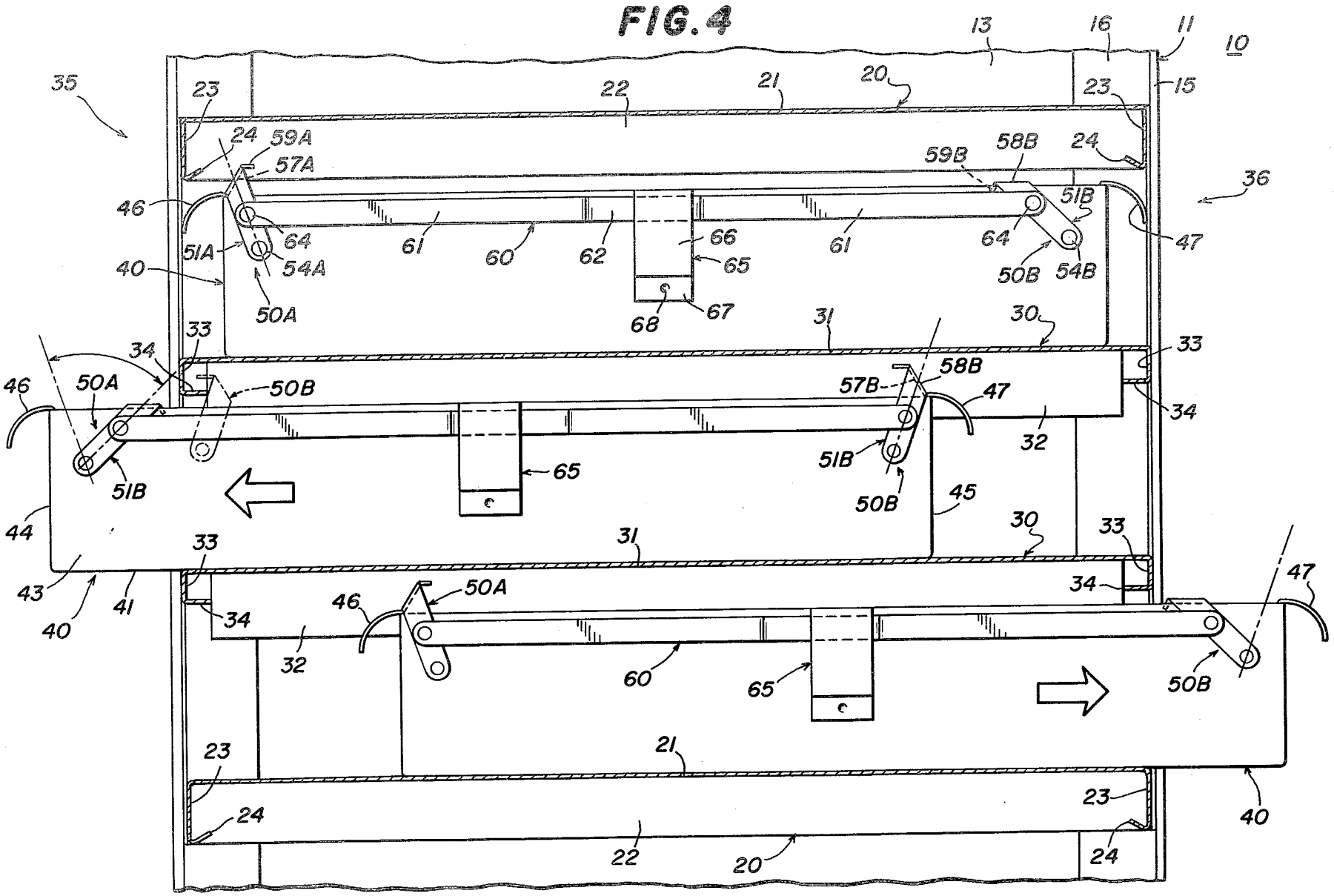
FIG. 4 is a further enlarged fragmentary view in vertical section taken along the line 4—4 in FIG. 3 and illustrating a plurality of the shelf boxes, with two of them being respectively partially withdrawn from opposite sides of the rack.

Referring also to FIGS. 2 through 4 of the drawings, each of the upright posts 11 is preferably T-shaped in transverse cross section, and includes an outer flange 15 corresponding to the crossbar of the "T" and an inner flange 16 disposed normal to the outer flange 15 substantially centrally thereof and corresponding to the stem of the "T", the posts 11 being arranged so that the outer flanges 15 thereof along each side of the shelf rack 10 are substantially coplanar, and the inner flanges 16 thereof along each end of the shelf rack 10 are substantially coplanar.

Preferably, each of the upright posts 11 is provided with a plurality of longitudinally spaced-apart shelf clips (not shown) thereon, for respectively supporting the corners of a plurality of vertically spaced-apart and substantially horizontally disposed primary shelves, each generally designated by the numeral 20. Each of the primary shelves 20 includes a flat rectangular support plate 21 provided at the opposite side edges thereof respectively with a pair of depending side flanges 22 and provided at the opposite ends thereof respectively with a pair of depending end flanges 23, each of the end flanges 23 being provided at the lower end thereof with an upwardly and inwardly inclined short retaining flange 24 (see FIG. 4). The primary shelves 20 are preferably spaced about one foot apart and may be used by themselves for supporting therebetween large shelf boxes of approximately one foot depth.

If it is desired to mount smaller shelf boxes in the shelf rack 10, intermediate shelf uprights 25 (see FIG. 3) are mounted on the inner surfaces of the upright posts 11 between the primary shelves 20. Each of these intermediate shelf uprights is provided with a plurality of vertically spaced-apart shelf retaining clips or members (not shown) for supporting thereon the opposite sides of a plurality of vertically spaced-apart and substantially horizontally disposed intermediate shelves, each generally designated by the numeral 30. Each of the intermediate shelves 30 includes a flat rectangular support plate 21 provided at the opposite side edges thereof respectively with a pair of depending side flanges 32 and provided at the opposite ends thereof respectively with a pair of depending end flanges 33, each of the end flanges 33 being provided at the lower end thereof with an inwardly extending retaining flange 34 which is disposed substantially parallel to the support plate 31.

It will be appreciated that in lieu of the intermediate shelf uprights 25 and intermediate shelves 30, the shelf rack 10 could simply be provided with a greater number of shelf clips on the upright posts 11 spaced apart at shorter intervals to permit mounting of additional primary shelves 20. But the primary shelves 20 are preferably heavier duty shelves with larger flanges than are the intermediate shelves 30 and, therefore, it is more economical to use the intermediate shelf arrangement for the mounting of small shelf boxes.

Figure 5:
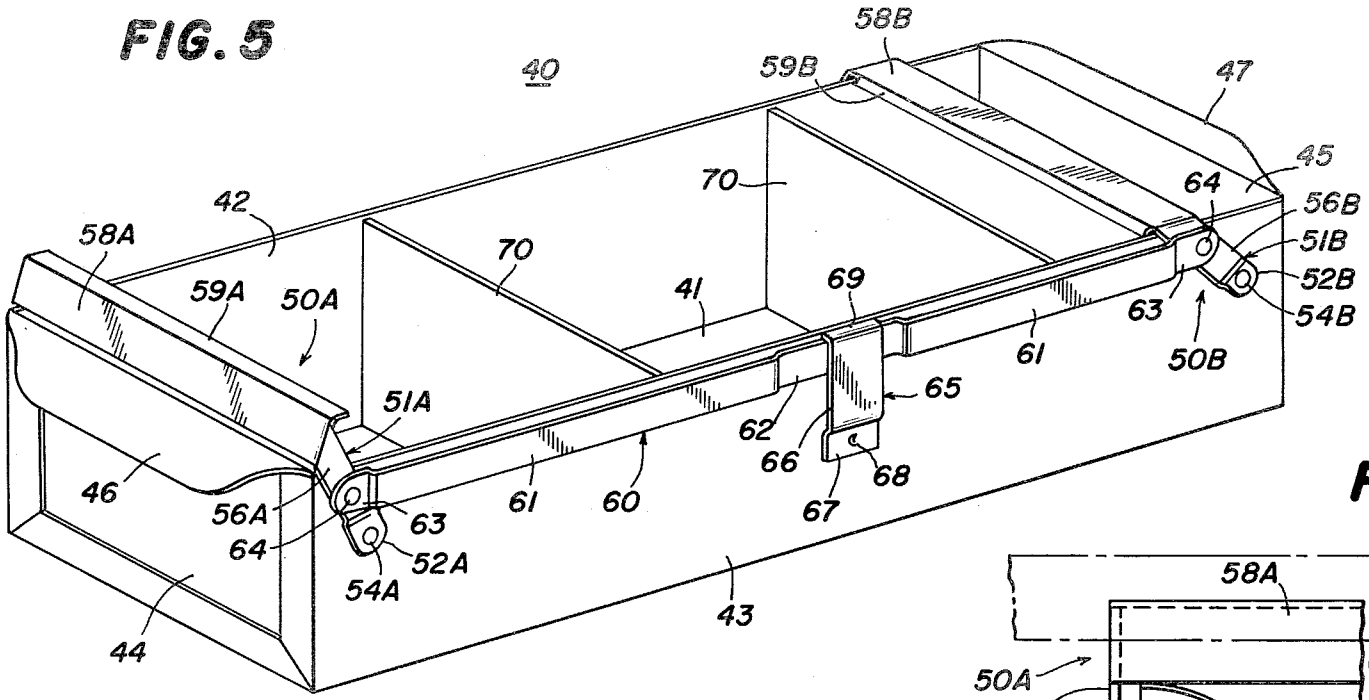
FIG. 5 is a perspective view of one of the shelf boxes constructed in accordance with and embodying the features of the present invention.
Figure 6:
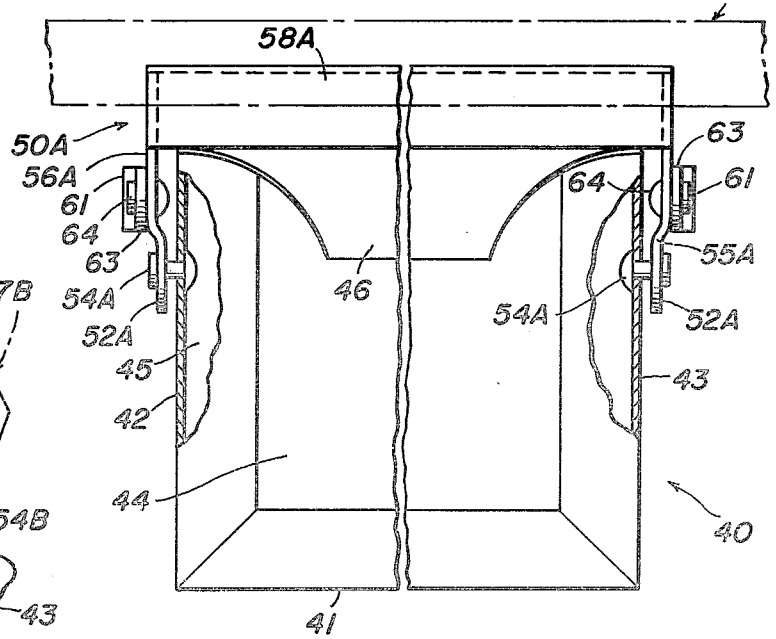
FIG. 6 is an enlarged end elevational view of the left-hand end of the shelf box of FIG. 5, with portions thereof broken away more clearly to illustrate the construction thereof.
Figure 7:
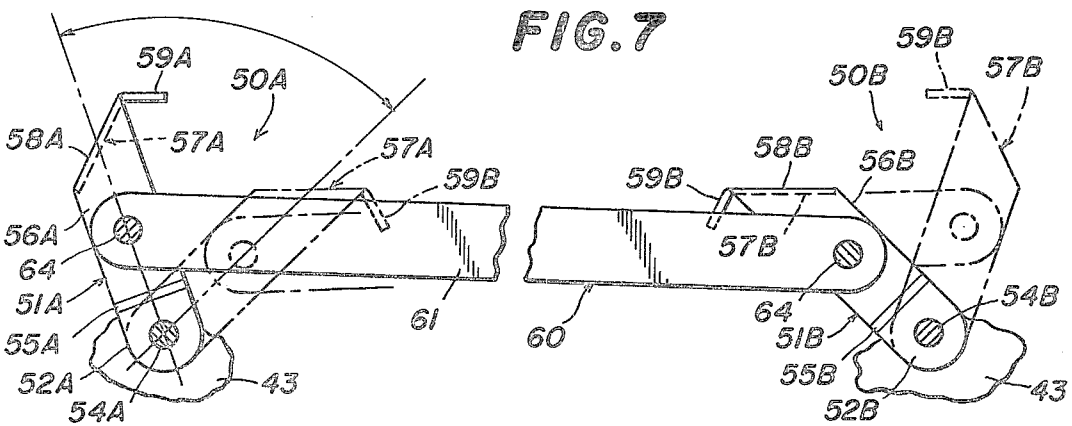
FIG. 7 is a fragmentary side elevational view of the stop mechanism of the shelf box of FIGS. 5 and 6, illustrating the different positions thereof.

As was indicated above, and as is well known in the art, each of the shelves 20 and 30 is adapted for supporting slidably thereon a plurality of shelf boxes, each generally designated by the numeral 40, in side-by-side arrangement. To facilitate the further description of the present invention, the side of the shelf rack 10 shown in FIG. 3 and disposed at the left-hand side of FIGS. 2 and 4 has been designated as the first front side 35 of the shelf rack 10, while the opposite side has been designated as the second front side 36 of the shelf rack 10. Referring also to FIGS. 5 through 7 of the drawings, each of the shelf boxes 40 is of elongated rectangular construction, having a length such that it extends substantially from the first front side 35 to the second front side 36 of the shelf rack 10. The width and height of the shelf box 40 may vary, however, depending upon the size and nature of the items to be stored therein. The shelf box 40 includes a rectangular bottom wall 41 and a pair of opposed upstanding rectangular side walls 42 and 43 and a pair of upstanding rectangular end walls 44 and 45, all cooperating to form a rectangular open-top box, with the upper edges of the walls 42–45 all being substantially coplanar. Respectively integral with the end walls 44 and 45 at the upper ends thereof and projecting outwardly therefrom are handles 46 and 47 which are respectively disposed in use for grasping by a user's hand to facilitate withdrawal of the adjacent end of the shelf box 40 from the shelf rack 10.

Respectively mounted on the shelf box 40 adjacent to the opposite ends thereof are two stop members, respectively generally designated by the numerals 50A and 50B, which are substantially identical in construction, but different in orientation. Since the stop members 50A and 50B are of substantially identical construction, only the stop member 50A will be described in detail, it being understood that the corresponding parts of the stop member 50B have the same reference numerals with the suffix B. The stop member 50A includes a pair of arms 51A, each provided with an inwardly offset attachment end 52A. The arms 51A are respectively disposed along the outer surfaces of the shelf box side walls 42 and 43 adjacent to the end wall 44 thereof, and are respectively pivotally mounted on the side walls 42 and 43 by coaxial pivot mounting pins 54A which are respectively received through complementary openings in the attachment ends 52A. Integral with each of the attachment ends 52A is a short transition portion 55A which is in turn integral with an upper end 56A of the arm 51A which is parallel to and offset laterally outwardly from the attachment end 52A. Integral with the upper ends 56A of the arms 51A and extending therebetween is a flat rectangular cam plate 57A having an outer cam surface 58A and being provided along the inner edge thereof with a short rectangular retaining lip 59A which is disposed at a predetermined angle to the plane of the cam surface 58A.

In use, the stop member 50A is pivotally movable about the axis of the pivot pins 54A between a stop position, illustrated in solid line in FIGS. 5, 6 and 7, and a release position, illustrated in broken line in FIG. 7. In the stop position thereof, the arms 51A are tilted forward toward the end wall 44 of the shelf box 40, with the cam surface 58A being disposed at a predetermined acute angle with the bottom wall 41 of the shelf box 40 and with the retaining lip 59A disposed substantially parallel to the shelf box bottom wall 41. In the release position thereof, the arms 51A are tilted rearwardly toward the end wall 45 of the shelf box 40, with the cam plate 57A lying across the upper edges of the shelf box side walls 42 and 43 in engagement therewith and substantially parallel to the bottom wall 41, and with the retaining lip 59A projecting downwardly between the side walls 42 and 43 of the shelf box 40.

Similarly, the stop member 50B is disposed adjacent to the end wall 45 of the shelf box 40, and is pivotally movable about the axis of the pins 54B for movement between a stop position, illustrated in broken line in FIG. 7, and a release position, illustrated in solid line in FIGS. 5 and 7. In the stop position of the stop member 50B, the arms 51B are tilted rearwardly toward the end wall 45 of the shelf box 40, with the cam surface 58B disposed at a predetermined angle to the bottom wall 41, and with the retaining lip 59B disposed substantially parallel to the bottom wall 41 of the shelf box 40 and projecting forwardly toward the end wall 44 thereof. In the release position thereof, the arms 51B of the stop member 50B are inclined forwardly, with the cam plate 57B spanning and lying along the top edges of the side walls 42 and 43 of the shelf box 40, and with the retaining lip 59B extending downwardly between the side walls 42 and 43 at a predetermined acute angle to the bottom wall 41.

Interconnecting the stop members 50A and 50B are two link straps or rails, each generally designated by the numeral 60, which are respectively disposed along the outside of the shelf box side walls 42 and 43 and are substantially identical in construction. Each of the link straps 60 includes two flat rectangular and coplanar main sections 61 disposed parallel to the adjacent side wall 42 or 43, and interconnected by a flat rectangular center section 62 which is offset laterally inwardly of the shelf box 40 with respect to the main sections 61. The main sections 61 are respectively integral at the outer ends thereof with laterally inwardly offset end sections 63, which are respectively pivotally connected to the upper ends 56A and 56B of the adjacent arms 51A and 51B of the stop members 50A and 50B by means of pivot pins 64.

The link straps 60 cooperate with the stop members 50A and 50B to effect controlled simultaneous movement thereof between the stop and release positions thereof, the linkage being so arranged that when either one of the stop members 50A or 50B is in the stop position thereof, the other one is in the release position thereof, as is best illustrated in FIG. 7.

Respectively mounted on the side walls 42 and 43 of the shelf box 40 intermediate the ends thereof are two identically constructed clips (one shown), generally designated by the numeral 65. Each of the clips 65 has a flat rectangular main body portion 66 integral at the lower end thereof with a laterally inwardly offset attachment flange 67 which is fixedly secured to the adjacent shelf box side wall 42 or 43 as by a spot weld 68. Integral with the main body portion 66 at the upper end thereof and projecting laterally inwardly therefrom to the adjacent shelf box side wall 42 or 43 is a short closure flange 69. Thus, it will be appreciated that the clip 65 defines a slot or channel between the main body portion 66 and the adjacent shelf box side wall 42 or 43 for retaining the center section 62 of the adjacent link strap 60 therein and limiting the movement thereof.

Preferably, each clip 65 is so dimensioned that the outer surface of the main body portion 66 does not extend laterally outwardly beyond the outer surfaces of the main section 61 of the link strap 60, for a purpose to be described more fully below.

If desired, one or more divider plates 70 may be provided within the shelf box 40 for dividing the interior thereof into a plurality of compartments for respectively storing different sizes or types of objects.

The operation of the shelf box 40 will now be described, with particular reference to FIG. 4 of the drawings. The shelf box 40 is normally disposed between two adjacent ones of the shelves 20 or 30, in sliding engagement with the underlying one of the shelves, the dimensions of the shelf box 40 and the stop members 50A and 50B being such that when the stop members 50A and 50B are disposed in their stop positions they extend upwardly above the level of the retaining flanges 24 or 34 of the overlying shelf 20 or 30. In order initially to insert the shelf box 40 into the shelf rack 10, the stop member (50B, for example) at the insertion end of the shelf box 40 is placed in its release position, and the adjacent end of the shelf box 40 is inserted into the first front side 35 of the shelf rack 10. Then, when the shelf box 40 has been partially inserted into the shelf rack 10, the stop member 50A is manually pushed down to its release position, permitting full insertion of the shelf box 40 into its closed position illustrated at the top of FIG. 4, wherein neither end of the shelf box 40 extends beyond the adjacent side of the shelf rack 10.

It is a principal feature of the present invention that the shelf box 40 can readily be withdrawn or opened from either front side 35 or 36 of the shelf rack 10. When, for example, the stop member 50A is disposed in its stop position and the stop member 50B is disposed in its release position, the end wall 45 of the shelf box 40 can be withdrawn from the second front side 36 of the storage rack 10 by pulling on the handle 47, the stop member 50B in its release position passing freely beneath the retaining flange 24 or 34 at the rear side of the shelf rack 10. This opening movement is in the direction of the arrow at the bottom of FIG. 4, and will continue uninterrupted until the end wall 45 of the shelf box 40 is almost completely withdrawn from the shelf rack 10. At this point, the stop member 50A will engage the retaining flange 24 or 34 of the overlying shelf 20 or 30 and prevent complete withdrawal of the shelf box 40. More particularly, the retaining lip 59A will ride over the retaining flange 24 or 34, and the rearward edges of the upper ends 56A of the arms 51A will engage the distal edge of the retaining flange 24 or 34.

Because the stop member 50B in its release position is in engagement with the upper edges of the shelf box side walls 42 and 43, it cannot pivot any further downwardly and, accordingly, by reason of the link straps 60, further pivoting of the stop member 50A toward its stop position is also prohibited. Thus, when the stop member 50A in its stop position engages the retaining flange 24 or 34 of the overlying shelf 20 or 30 it will positively stop the withdrawal of the shelf box 40.

If it should be desired to completely remove the shelf box 40 from the shelf rack 10, the shelf box 40 is reinserted a slight distance until the stop member 50A is completely out of overlapping relationship with the retaining flange 24 or 34, and then the stop member 50B is manually raised to its stop position, simultaneously moving the stop member 50A to its release position and permitting free removal of the shelf box 40 in the direction of the arrow at the lower end of FIG. 4.

Withdrawal of the end wall 44 of the shelf box 40 is accomplished in exactly the same manner. If, when the end wall 44 of the shelf box 40 is withdrawn from the shelf rack 10, the stop member 50A is in its stop position, the cam surface 58A thereof will engage the retaining flange 24 or 34 at the adjacent end of the overlaying shelf 20 or 30, but instead of stopping the withdrawal of the shelf box 40, the stop member 50A will be cammed rearwardly to a position wherein the stop member 50A has been lowered sufficiently to pass beneath the retaining flange 24 or 34, at which point the stop member 50A will continue to fall by gravity to its release position. This movement of the stop member 50A from its stop position to its release position effects a simultaneous movement of the stop member 50B from its release position to its stop position by operation of the link straps 60. Thus, withdrawal of the end wall 44 of the shelf box 40 is accommodated until the stop member 50B engages the retaining flange 24 or 34 of the overlying shelf 20 or 30 at the first front side 35 of the shelf rack 10 for limiting withdrawal of the shelf box 40, in the same manner as was described above.

It will be noted that the stop members 50A and 50B are so arranged that as the end wall 44 of the shelf box 40 is being withdrawn, the point at which the stop member 50A begins to fall away beneath the retaining flange 24 or 34 to its release position is the same point at which the arms 51B of the stop member 50B pass the vertical orientation, so that they also will continue to fall by gravity to their full stop position. This same operation is also true, of course, when the stop members 50A, 50B and link straps 60 are moving in the opposite direction. It will be appreciated from FIG. 7 that as the stop members 50A and 50B move between their stop and release positions, the link straps 60 also undergo tilting movements between the solid line and broken line positions illustrated in FIG. 7, which movements are accommodated by the clips 65.

It is another important feature of the present invention that the laterally outermost portions of the shelf box 40 are the main sections 61 of the link straps 60. Thus, when a plurality of shelf boxes 40 is arranged in side-by-side relationship on one of the shelves 20 or 30, the main sections 61 of the link straps 60 are the only portions of the shelf boxes 40 which will come into abutting engagement with each other. Thus, the main sections 61 of the link straps 60 define bearing surfaces which permit free sliding engagement of the adjacent shelf boxes with respect to each other without any snagging or catching of the stop mechanism. It is, therefore, necessary that for all shelf boxes of the same size or which are to be mounted on the same shelf, the link straps 60 must be disposed in substantially the same position so that they will be positioned for sliding engagement with each other.

In a constructional model of the shelf box 40 of the present invention, the parts are preferably formed of metal, such as sheet metal or the like, but it will be understood that other relatively rigid materials could be used.

From the foregoing, it can be seen that there has been provided an improved shelf box which can readily be withdrawn from either side of a shelf rack or storage cabinet, and yet is arranged to prevent accidental complete removal of the shelf box in either direction.

More particularly, there has been provided an improved shelf box with a novel, linked, dual stop mechanism mounted on the shelf box for cooperation with the overlying shelf to permit partial withdrawal but to prevent accidental complete withdrawal of the shelf box in either direction.

There has also been provided a shelf box which is of simple and economical construction, characterized by ease and simplicity of use.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A shelf box for use at either side of a shelf rack which is open at opposite sides thereof and includes a plurality of parallel spaced-apart shelves each having two retaining portions extending downwardly therefrom along the entire length thereof, said shelf box comprising an open-top receptacle having opposed ends and being adapted for slidable disposition between adjacent ones of the associated shelves from either side thereof anywhere along the length thereof and dimensioned longitudinally to extend substantially from one side to the other side of the associated rack, with no portion of said receptacle extending above the retaining portions of the overlying shelf, a first stop member mounted on said receptacle adjacent to a first one of said ends for movement between a stop position extending upwardly above the top of said receptacle and engageable with the retaining portions of one of the adjacent shelves and a release position non-engageable with the retaining portions of the shelves, a second stop member mounted on said receptacle adjacent to a second one of said ends for movement between a stop position extending upwardly above the top of said receptacle and engageable with the retaining portions of one of the adjacent shelves and a release position non-engageable with the retaining portions of the shelves, each of said stop members in the release position thereof accommodating withdrawal of the adjacent end of said receptacle from the associated rack, each of said stop members in the stop position thereof being engageable with one of the associated retaining portions for movement of said stop member to the release position thereof to accommodate withdrawal of the adjacent end of said receptacle from the associated rack and being engageable with the other of the associated retaining portions for limiting withdrawal of the opposite end of said receptacle from the associated rack, and control means for effecting movement of each of said stop members from the release position to the stop position thereof, whereby said shelf box may be opened from either side of the rack while preventing inadvertent complete removal of the shelf box from the rack.

2. The shelf box of claim 1, wherein each of said stop members is mounted for pivotal movement between the stop and release positions thereof.

3. The shelf box of claim 1, wherein said control means is responsive to movement of one of said stop members from the stop position to the release position thereof for effecting movement of the other stop member from the release position to the stop position thereof.

4. The shelf box of claim 1, wherein said first and second stop members are substantially identical in construction.

5. A shelf box for use at either side of a shelf rack which is open at opposite sides thereof and includes a plurality of parallel spaced-apart shelves each having two retaining portions, said shelf box comprising an open-top receptacle having opposed ends and being adapted for slidable disposition between adjacent ones of the associated shelves from either side thereof and dimensioned longitudinally to extend substantially from one side to the other side of the associated rack, a first stop member mounted on said receptacle adjacent to a first one of said ends for movement between a stop position engageable with the retaining portions of one of the adjacent shelves and a release position non-engageable with the retaining portions of the shelves, a second stop member mounted on said receptacle adjacent to a second one of said ends for movement between a stop position engageable with the retaining portions of one of the adjacent shelves and a release position nonengageable with the retaining portions of the shelves, and linkage means interconnecting said first and second stop members for effecting simultaneous movement thereof between the stop and release positions thereof so that when either of said stop members is in the stop position thereof the other stop member is in the release position thereof, each one of said stop members in the release position thereof accommodating free withdrawal of the adjacent end of said receptacle from the associated rack, each one of said stop members in the stop position thereof being engageable with one of the associated retaining portions for moving said stop member to the release position thereof to accommodate withdrawal of the adjacent end of said receptacle from the associated rack and move the other one of said stop members to the stop position thereof and being engageable with the other of the associated retaining portions for limiting withdrawal of the opposite end of said receptacle from the associated rack, whereby said shelf box may be opened from either side of the rack while preventing inadvertent complete removal of the shelf box from the rack.

6. The shelf box of claim 5, wherein said first and second stop members are pivotally movable between the stop and release positions thereof, said linkage means including an elongated rigid member pivotally connected to each of said stop members.

7. The shelf box of claim 6, wherein said rigid member is disposed outside of said receptacle.

8. The shelf box of claim 5, wherein said first and second stop members are pivotally movable between the stop and release positions thereof, said linkage means including an elongated rigid member pivotally connected to each of said stop members, and further including a retaining clip carried by said receptacle and cooperating therewith for limiting the movement of said linkage means.

9. The shelf box of claim 5, wherein each of said stop members includes a cam surface disposed in the stop position of said stop member for camming engagement with one of the associated retaining portions for cammed movement of said stop member to the release position thereof.

10. The shelf box of claim 5, wherein said linkage means includes two elongated rigid members respectively disposed outside of the opposite sides of said receptacle and pivotally connected to each of said stop members.

11. The shelf box of claim 5, wherein said linkage means includes two members respectively disposed outside of said receptacle along the opposite sides thereof, each of said linkage means including bearing portions comprising the laterally outermost portions of said shelf box and disposed for sliding engagement with like bearing portions of laterally adjacent shelf boxes.

12. A shelf box for use at either side of a shelf rack which is open at opposite sides thereof and includes a plurality of parallel spaced-apart shelves each having two retaining portions, said shelf box comprising an open-top receptacle having opposed ends and being adapted for slidable disposition between adjacent ones of the associated shelves from either side thereof and dimensioned longitudinally to extend substantially from one side to the other side of the associated rack, a first stop member disposed adjacent to a first one of said ends and including a pair of arms respectively pivotally mounted at opposite sides of said receptacle and a bight portion interconnecting said arms and overlying said receptacle, a second stop member mounted on said receptacle adjacent to a second one of said ends and including a pair of upstanding arms respectively pivotally mounted at opposite sides of said receptacle and a bight portion interconnecting said arms and overlying said receptacle, each of said stop members being pivotally movable between a stop position wherein said bight portion is disposed a predetermined distance above the top of said receptacle for engagement with the retaining portions of the overlying one of the adjacent shelves and a release position wherein said bight portion is disposed against the top of said receptacle and non-engageable with the retaining portions of the overlying shelf, and linkage means disposed alongside said receptacle and interconnecting corresponding arms of said first and second stop members for effecting simultaneous movement thereof between the stop and release positions thereof so that when either of said stop members is in the stop position thereof the other stop member is in the release position thereof, each one of said stop members in the release position thereof accommodating free withdrawal of the adjacent end of said receptacle from the associated rack, each one of said stop members in the stop position thereof being engageable with one of the overlying retaining portions for moving said stop member to the release position thereof to accommodate withdrawal of the adjacent end of said receptacle from the associated rack and move the other one of said stop members to the stop position thereof and being engageable with the other of the overlying retaining portions for limiting withdrawal of the opposite end of said receptacle from the associated rack, whereby said shelf box may be opened from either side of the rack while preventing inadvertent complete removal of the shelf box from the rack.

13. The shelf box of claim 12, wherein said bight portion of each said stop member includes a substantially flat rectangular member which is disposed substantially parallel to the associated shelves in the release position of said stop member and is disposed at a predetermined angle to said shelves in the stop position of said stop member.

14. The shelf box of claim 12, wherein each of said bight portions includes a retaining tab which cooperates with the associated ones of said arms to define a retaining hook engageable with one of the associated retaining portions for preventing complete withdrawal of the opposite end of said receptacle from the associated rack.

* * * * *